US006032437A

United States Patent [19]

Bois

[11] Patent Number: 6,032,437

[45] Date of Patent: Mar. 7, 2000

[54] AUTOMATIC MACHINE FOR FORMING, FILLING, AND SEALING BAGS HAVING TRANSVERSE CLOSURE STRIPS, AND BAGS OBTAINED THEREBY

[75] Inventor: Henri Georges Bois, Neuilly sur Seine, France

[73] Assignee: Flexico-France, Henonville, France

[21] Appl. No.: 09/187,103

[22] Filed: Nov. 5, 1998

[30] Foreign Application Priority Data

Nov. 6, 1997 [FR] France ..... 97 13944

[51] Int. Cl.[7] ..... B65B 51/04

[52] U.S. Cl. ..... 53/412; 53/133.4; 53/139.2; 53/451; 53/551; 493/213; 493/214; 493/927

[58] Field of Search ..... 493/213, 214, 493/927; 53/133.1, 133.2, 133.4, 139.2, 410, 412, 451, 551

[56] References Cited

U.S. PATENT DOCUMENTS

| | | | |
|---|---|---|---|
| 3,839,128 | 10/1974 | Arai | 493/214 X |
| 4,341,575 | 7/1982 | Herz | 493/214 X |
| 4,528,224 | 7/1985 | Ausnit | 493/214 X |
| 4,617,683 | 10/1986 | Christoff | 53/139.2 X |
| 4,655,862 | 4/1987 | Christoff et al. . | |
| 4,709,398 | 11/1987 | Ausnit | 53/139.2 X |
| 4,709,533 | 12/1987 | Ausnit | 53/139.2 X |
| 4,736,451 | 4/1988 | Ausnit . | |
| 4,844,759 | 7/1989 | Boeckmann | 493/927 X |
| 4,878,987 | 11/1989 | Van Erden . | |
| 4,909,017 | 3/1990 | McMahon et al. | 53/133.4 X |
| 4,923,309 | 5/1990 | Van Erden . | |
| 5,096,516 | 3/1992 | McDonald et al. | 493/214 X |
| 5,127,208 | 7/1992 | Custer et al. | 53/133.4 X |
| 5,322,579 | 6/1994 | Van Erden | 53/551 X |
| 5,400,565 | 3/1995 | Terminella et al. | 53/133.4 |
| 5,412,924 | 5/1995 | Ausnit | 53/133.4 X |
| 5,417,035 | 5/1995 | English | 53/133.4 X |
| 5,557,907 | 9/1996 | Malin et al. | 53/139.2 |
| 5,782,733 | 7/1998 | Yeager | 493/213 |
| 5,816,018 | 10/1998 | Bois | 53/133.4 |

*Primary Examiner*—Daniel B. Moon

*Attorney, Agent, or Firm*—Pitney, Hardin, Kipp and Szuch LLP

[57] ABSTRACT

The present invention relates to a machine for forming packaging on the basis of film that includes complementary closure strips, the machine comprising: feeder means for feeding onto the film a closure means comprising two support webs provided with at least a first longitudinal assembly constituted by two complementary strips and with a second longitudinal assembly disposed at a distance from the first, urging means for urging the support webs towards each other between the two longitudinal assemblies, and two rectilinear guides suitable for penetrating respectively into the gaps between each pair of lateral edges of the support webs. The present invention also provides a method, the resulting packages, and closure means for this purpose.

38 Claims, 3 Drawing Sheets

FIG. 4bis

AUTOMATIC MACHINE FOR FORMING, FILLING, AND SEALING BAGS HAVING TRANSVERSE CLOSURE STRIPS, AND BAGS OBTAINED THEREBY

FIELD OF THE INVENTION

The present invention relates to the field of bags or sachets comprising complementary closure strips adapted to enable a user to open and close them successively at will.

More precisely, the present invention relates to the field of machines for this purpose, in particular automatic machines adapted to form, fill, and close packages based on film, in particular a film of thermoplastic material, and having complementary closure strips, e.g. complementary male and female closure strips.

BACKGROUND OF THE INVENTION

Such machines are often referred to by the initials FFS for "form, fill, and seal" machine.

Numerous machines of this type have already been proposed (see for example documents EP-A-528 721 and U.S. Pat. No. 4,894,975.

Most such machines comprise a forming neck which receives at its input the film in the flat state taken from a payout stand and which delivers at its output the film shaped into a tube, a filler chute opening out into the forming neck and consequently into said tube, means for feeding closure means onto the film and for fixing them to the film, longitudinal heat-sealing means for closing the tube longitudinally, and means suitable for generating sequentially a first transverse line of heat-sealing before a product is inserted into the tube via the filler chute, and then a second transverse line of heat-sealing after the product has been inserted into the tube, in order to close a package around the product.

Still more precisely, most machines that have been proposed so far are designed to receive their closure strips in the longitudinal direction, i.e. parallel to the film travel direction. However, such machines with longitudinal strips suffer from the drawback of limiting the height of the resulting bags. This height is equal to half the circumference of the forming neck. In addition, packages obtained on such machines sometimes leak. This is a result in particular of the fact that the operation of the transverse heat-sealing means is disturbed by the extra thickness formed by the longitudinal strips.

Numerous attempts have been made to improve the above situation, by placing the closure strips not longitudinally, i.e. parallel to the travel direction of the film, but transversely, i.e. perpendicular to the travel direction of the film.

The earliest attempt on those lines known to the inventors is described in documents U.S. Pat. No. 4,617,683 and U.S. Pat. No. 4,655,862. Those documents, which are more than 10 years old, propose two solutions for bringing the transverse strips onto the film while it is in the flat state prior to reaching the forming neck. The first solution consists in moving segments of closure strip laterally by drive wheels placed beside the edge of the travelling film, acting in combination with a transversely movable suction head. The second solution consists in placing closure strips on the film by using a rotary cylinder fitted with pneumatically controlled temporary holding means.

Those proposals were found initially to be quite promising. Unfortunately, they did not give satisfaction and they have been abandoned by the person skilled in the art. In particular, it was found that the means described in the above-mentioned documents did not always ensure that, when placed on the film, the strips were in an accurately rectilinear state. Consequently, it was often difficult to make the complementary strips cooperate with each other.

Other solutions were then proposed in an attempt to overcome the drawbacks that resulted from implementing the means described in the above-mentioned documents.

For example, in document U.S. Pat. No. 4,666,536, it is proposed to wind a part of the film on a core and to bring a closure strip segment extending across the width of the film onto said wound part of the film by means of a heating tunnel that serves to fix the strips. Theoretically, the means described in that document have the advantage of enabling forming to take place with a continuously travelling film. Unfortunately, such means have turned out to be very complex and difficult to implement.

Document U.S. Pat. No. 4,701,361 proposes forming a film which is provided sequentially with complementary closure strips by extruding a tubular film fitted with helically wound closure strips that are extruded therewith or that are applied thereto, and then cutting the tubular film helically to obtain a tape that is provided with uniformly distributed transverse strips.

To reduce the length of the strips deposited on the film, and consequently to improve the positioning thereof, document U.S. Pat. No. 4,878,987 proposes supplying the strips not from a supply on one side only, as described in document U.S. Pat. No. 4,617,863 and U.S. Pat. No. 4,655,862, but from two supplies of strips disposed on respective sides of the film that is to form the bags. Thus, each of the two strip segments displaced over the film, from the respective supplies on either side, no longer covers the entire width of the film, but only half the width.

Thereafter, document U.S. Pat. No. 4,844,759 proposed two other solutions. The first proposed solution consists in driving the closure strips by means of an endless belt onto a bracket superposed over the film and capable of pivoting through 180° in order to overturn the closure strips onto said film. Thus, the strips are initially conveyed with their relief directed towards the film but on the bracket. After which they are turned over so that the relief is directed away from the film and so that they are ready to be fixed thereon. The second solution consists in conveying the strips transversely against a shoe superposed above the film and then in lowering the shoe against the film so as to fix the closure strips in place.

After observing that none of the techniques described in the above-mentioned documents gives satisfaction, proposals were made in document U.S. Pat. No. 5,111,643 for an entirely different approach, consisting not in fixing the closure strips on the film prior to bringing the film to the forming neck as described in the above-mentioned documents, but in initially shaping the film into a tube on the forming neck, and then bringing the closure strips onto the tubular film. For this purpose, document U.S. Pat. No. 5,111,643 proposes a complex installation including a chute which opens out in the base of the forming neck to bring the closure strips which are carried on a support tape, and a chute for taking away the support tape.

Other means designed to place closure strips transversely onto a film are described in document U.S. Pat. No. 4,709,398 and U.S. Pat. No. 4,909,017.

The Applicant has itself defined in its patent application FR-A-2 745 261 a machine for forming film-based packages, which machine has means for bringing closure strips transversely onto a film, which means comprise a combination of a rectilinear guide superposed over the film and extending transversely thereto in order to position at least one closure strip accurately and transversely over the film, together with means for taking hold of the leading end of the closure strip and suitable for moving transversely along the guide so as to bring the closure strip into the guide by pulling on the leading end of the closure strip.

OBJECTS AND SUMMARY OF THE INVENTION

An object of the present invention is now to improve machines for forming film-based packages having complementary closure strips.

According to the present invention, this object is achieved by a machine comprising:

feeder means for feeding onto the film a closure means comprising two generally-parallel support webs provided, on their facing inside surfaces and at a distance from their lateral edges, with at least a first longitudinal assembly constituted by two complementary strips connected to respective ones of the two support webs, and with a second longitudinal assembly disposed at a distance from the first assembly in the width direction of the support webs;

urging means for urging the support webs towards each other between the two longitudinal assemblies and at least at the ends of the support webs, so that by deformation of the webs under the effect of said urging the distance between the lateral edges of the two webs increases; and two rectilinear guides suitable for penetrating into the respective spaces formed in this way between the two pairs of lateral edges of the support webs.

As explained below, the present invention applies particularly but not exclusively to machines in which the closure means are brought onto the film transversely to the direction thereof.

The invention preferably applies to an automatic machine for forming, filling, and sealing packages based on film, the machine, of conventional type, comprising a forming neck which receives at is input the film in the flat state taken from a payout stand and which delivers at its output the film shaped into a tube, a filler chute opening out into the forming neck and consequently into said tube, means for feeding closure means onto the film and for fixing them to the film, longitudinal heat-sealing means for closing the tube longitudinally, and means suitable for generating sequentially a first transverse line of heat-sealing before a product is inserted into the tube via the filler chute, and then a second transverse line of heat-sealing after the product has been inserted into the tube, in order to close a package around the product.

According to another advantageous characteristic of the invention, the feeder means are adapted to take segments of closure means of length no greater than about half the width of the film, to feed them transversely over the film before the film reaches the forming neck, and to fix a first one of the support webs on the film, and means are also provided suitable for fixing the second support web to the inside wall of the film once formed into a bag, after the bag has been filled, while the bag is being finished.

The above-mentioned urging means may be formed by temporary urging means, e.g. in the form of a wheel, a clamp, or equivalent means.

In a variant or in combination with the above-mentioned means, they may be formed by permanent urging means, e.g. in the form of heat-sealing at the ends of the segments of closure means.

To facilitate these operations of fixing support webs in two stages, the two support webs for the closure means are preferably of different widths.

The present invention also provides a method of forming packages, packages obtained thereby, and closure means for this purpose.

The method comprises the steps which consist in:

feeding onto the film closure means comprising two generally parallel support webs provided on their facing inside surfaces and at a distance from their lateral edges, with at least a first longitudinal assembly constituted by two complementary strips bonded respectively to the two support webs, and with a second longitudinal assembly disposed at a distance from the first assembly in the width direction of the support webs;

urging the support webs towards each other between the two longitudinal assemblies so that the distance between the lateral edges of the two webs increases under the effect of said urging, because of the webs being deformed; and engaging the closure means on two rectilinear guides in such a manner that the guides penetrate into the respective gaps formed in this way between each pair of lateral edges of the support webs.

The closure means of the present invention comprises two generally parallel support webs provided on their facing inside surfaces and at a distance from their lateral edges with at least a first longitudinal assembly constituted by two complementary strips bonded to respective ones of the two support webs, and with a second longitudinal assembly disposed at a distance from the first assembly in the width direction of the support webs, so that the gaps formed between the two pairs of side edges of the support webs can be enlarged by urging the support webs towards each other between the two longitudinal assemblies.

The present invention also specifically provides bags comprising two pairs of closure strips of the complementary male/female type, located at the mouth of the bag, with one male strip and one female strip on each of the sheets making up the bag.

The Applicant has observed that such bags lend themselves particularly well to packaging substances in powder form, for reasons that are explained below.

BRIEF DESCRIPTION OF THE DRAWINGS

Other characteristics, objects, and advantages of the present invention appear on reading the following detailed description with reference to the accompanying drawings, given by way of non-limiting example, and in which:

FIGS. 4 and 4*bis* show two variants of the cylinder of the present invention adapted to positioning the closure means;

MORE DETAILED DESCRIPTION

Figures 1, 6:
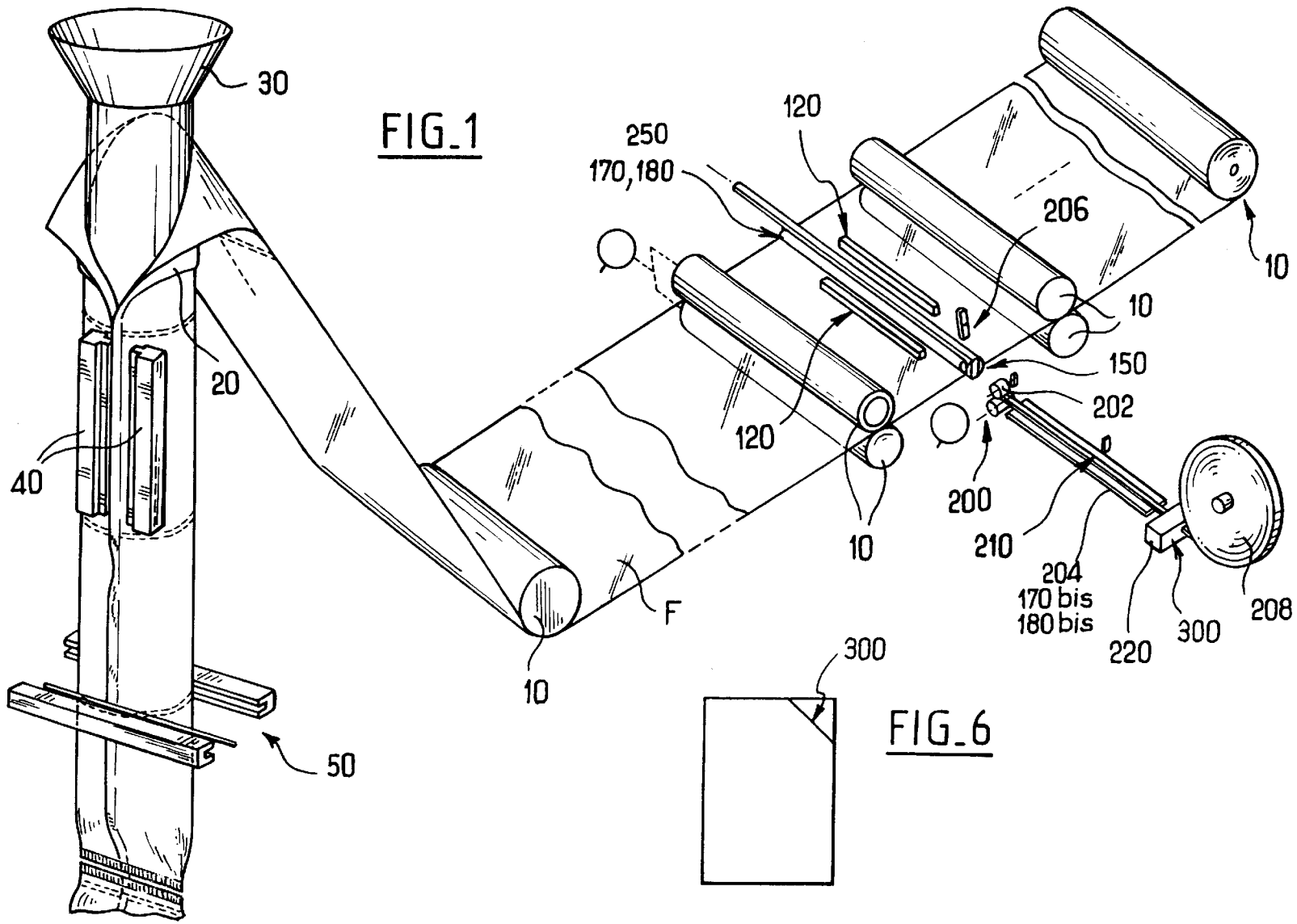
FIG. 1 is a diagrammatic perspective view of an automatic machine of the present invention for forming, filling, and sealing bags.
FIG. 6 is a diagrammatic plan view of a bag constituting a variant embodiment of the present invention.

Accompanying FIG. 1 shows the conventional general structure of an automatic machine for forming, filling, and sealing bags having complementary closure strips, the machine comprising:

means 10 for supplying film F;

a forming neck 20;

a filling chute 30;

longitudinal heat-sealing means 40; and transverse heat-sealing and bag-separation means 50.

Since this structure is known, it is not described in greater detail below.

However, as mentioned above, in a preferred embodiment of the invention, means are provided for bringing closure means 300 transversely over the film F before it reaches the forming neck 20 and for fixing said closure means 300 to the film F.

Also, in the invention, the closure means 300 has two generally parallel support webs 310, 320 provided on their facing inner surfaces 311, 321 and set back from the side edges thereof 315, 316, 325, 326, at least a first longitudinal assembly 302 constituted by two complementary strips 312, 322 connected to respective ones of the two support webs 310, 320, and a second longitudinal assembly 304 disposed at a distance from the first assembly 302 in the width direction of the support webs 310, 320.

In the particular example in the accompanying figures, the second assembly 304 is likewise constituted by two complementary strips 314, 324 respectively associated with the two support webs 310, 320.

However, in a variant, the second assembly 304 could be constituted by a single rib or reinforcement projecting longitudinally from the inner surface of one of the webs 310 or 320, or indeed from each of the webs 310 and 320.

Still more precisely, and as shown in the accompanying figures, each of the support webs 310 and 320 carries a male strip and a female strip. Nevertheless, in a variant it is possible to envisage that one of the webs carries two male strips while the second web carries two female strips.

Figure 3:
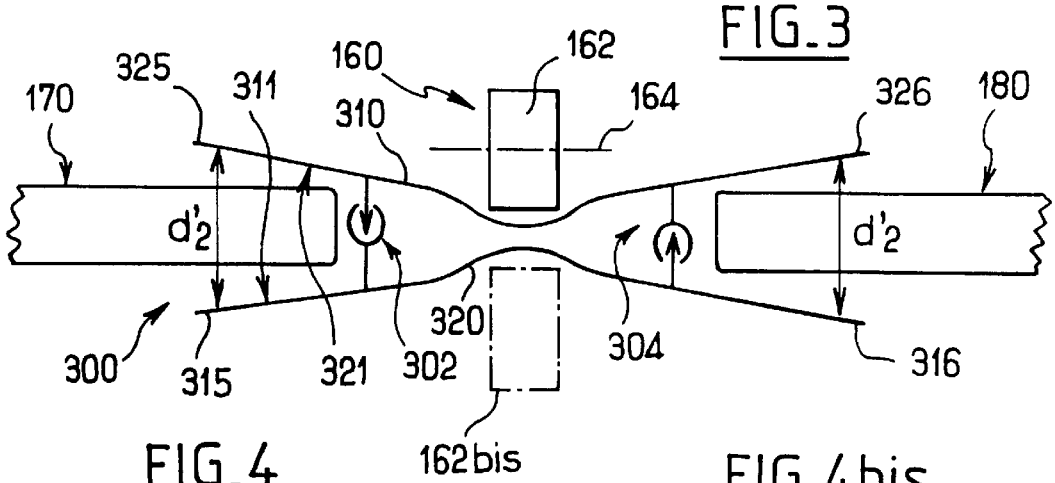
FIG. 3 is a view showing the same closure means under the effect of urging while being brought over the film.
Figure 5:
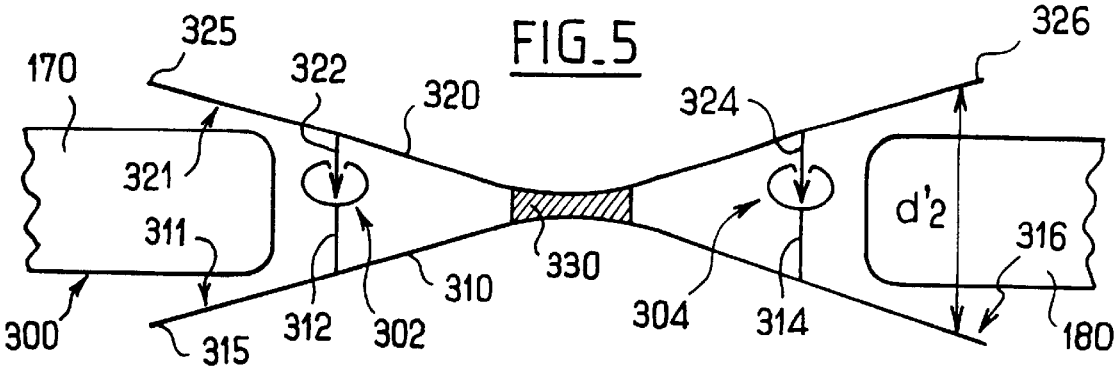
FIG. 5 is a cross-section view showing a variant of the closure means of the present invention, in which urging of the support webs is performed by a line of heat-sealing.

Also in the context of the present invention, the film feed means 10 are associated with means 160 for urging the support webs 310 and 320 towards each other between the two longitudinal assemblies 302, 304 so that the distance between the lateral edges of the two webs 315 and 325 or 316 and 326 increases because of this urging, with the webs 310 and 320 deforming, as can be seen in FIGS. 3 and 5.

For this purpose, the distance d1 between the two longitudinal assemblies 302 and 304 is preferably greater than the distance d2 that exists at rest between the webs 310 and 320 as defined by the assemblies 302 and 304. More precisely still, this distance d1 preferably lies in the range one to five times the distance d2.

Figure 2:
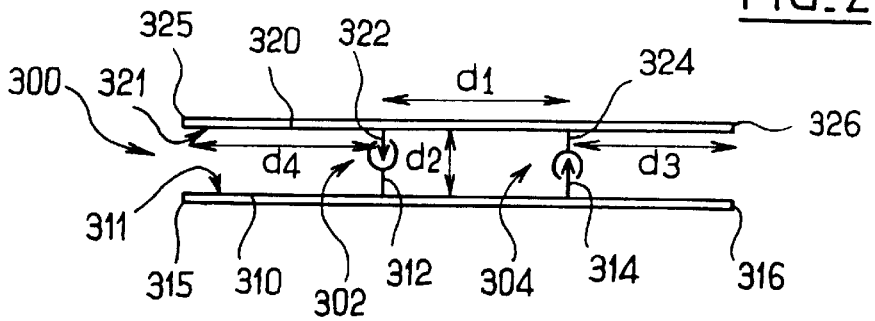
FIG. 2 is a diagram of an embodiment of closure means of the present invention.

On comparing FIGS. 2 and 3 or 5, it will be observed that the urging means 160 typically enable the distance between the lateral edges 315 & 325 and 316 & 326 of the webs to be approximately doubled compared with their rest position (in FIGS. 3 and 5, d'2 is about twice d2).

By way of non-limiting example, the distance d1 at rest can be about 3 mm, while d2 can be about 2 mm.

Figure 4:
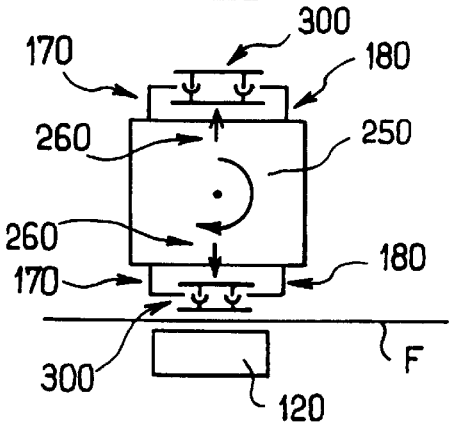
Figure 4:
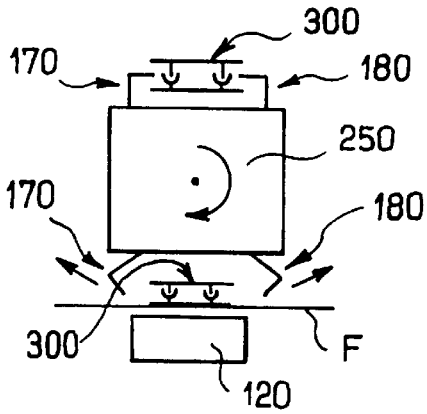

The feed means are also associated with two fixed parallel rectilinear guides 170, 180 (extending orthogonally to the longitudinal travel axis of the film) and suitable for penetrating respectively into the space thus formed between each pair of lateral edges 315 & 325 and 316 & 326 of the support webs 310, 320, as can be seen in FIGS. 3 to 5.

The right section of the guides 170, 180 can exist in numerous variants. As shown in the accompanying figures, these guides 170, 180 may be rectangular or oblong in right section.

The urging means 160 may be constituted by temporary urging means constituted by a wheel 162 whose axis 164 is parallel to the longitudinal travel axis of the film, as shown in FIG. 3, or by any equivalent means superposed over the closure means 300, immediately upstream from one of the guides 170, 180. The height of the urging means 160 relative to the closure means 300 is adapted so that the means 160 urge and deform at least one of the webs 310, 320 between the two assemblies 302, 304.

In another preferred embodiment of the invention, the urging means 160 can be formed by a clamp whose two jaws are suitable for urging the support webs 310, 320 towards each other between the two longitudinal assemblies 302, 304, as sketched at 162, 162*bis* in FIG. 3.

In another variant of the present invention, which can be used in combination with the above-mentioned temporary urging means, provision is also made for permanent urging means acting on the axial end of the webs 310, 320 between the two assemblies 305, 304, in the form of a line of heat-sealing as shown diagrammatically at 330 in FIG. 5.

Such a line of heat-sealing 330 is made before feeding segments of closure means 300 over the film F. It may be performed downstream from the cutting station 206. Nevertheless, it is preferable for the line of heat-sealing 330 to be made upstream from the cutting station 206, said cutting being performed through the middle of the line of heat-sealing made in this way, such that a line of heat-sealing 330 thus forms a bond both between the trailing ends of the webs for a first segment and between the leading ends of the webs for a second segment of closure means.

In FIG. 1, reference 220 designates a heat-sealing station suitable for performing the above-described line of heat-sealing 330.

Such a line of heat-sealing 330 also has the advantage of improving bag leakproofing and of preventing the strips 312 & 322, 314 & 324 being completely separated or removed when a bag is opened, thereby making it easier to re-engage the strips subsequently.

The widths d3 and d4 of the support webs project laterally from said assemblies 302 and 304 through distances that may be identical on both sides of the webs.

However these widths d3 and d4 can be different from one side to the other, while still being identical for both webs 310, 320, or indeed they can be different from one web to the other, particularly to make it easier to heat-seal the webs 310 and 320 to the film.

By way of non-limiting example, the distance d3 may be about 3 mm while the distance d4 may be about 8 mm.

The means 10 for feeding the closure means 300 transversely over the film F before the film reaches the forming neck 20 can themselves comprise numerous variants.

These feed means 10 are preferably as described in document FR-A-2 745 261.

More precisely, in this context, the feed means 10 thus preferably comprise:

two parallel rectilinear guides 170 and 180 overlying the film F and extending transversely to the displacement direction thereof, upstream from the forming neck 20; and grasping means 150 for taking hold of the leading end of the closure means 300; which grasping means 150 are suitable for moving transversely along the guides 170, 180 to feed the closure means 300 along the guides by pulling on the upstream end of the closure means.

The grasping means 150 can be implemented in various different ways.

As shown diagrammatically in accompanying FIG. 1, the grasping means are preferably formed by a clamp system that closes to take hold of the upstream end of a closure means 300 so as to feed it along the rectilinear guides 170, 180, and then opens in order to release the closure means 300 before returning to the initial position for taking hold as shown diagrammatically in FIG. 1.

In a variant embodiment, the grasping means 150 can be constituted by a suction head.

Naturally, and preferably, means are provided for moving the grasping means 150 in a transverse direction synchronously with the displacement of the film F.

Auxiliary means are preferably provided to feed the means 300: drive wheels 200, 202, a guide 204 for the closure means 300 upstream from the film F, means 206 for cutting the closure means 300 into segments (with the closure means 300 preferably being fed from a reel 208), and a position sensor 210.

The closure means 300 are fixed to the film F by any appropriate means, advantageously by heat-sealing jaws associated with the rectilinear guides 170 and 180, as shown diagrammatically under reference 120 in FIG. 1.

More precisely and preferably, the segments of closure means are heat-sealed onto the film F by means of a heat-sealing jaw 120 underlying the film and controlled sequentially to move towards and away from the film F so as to clamp the film and the web 310 of the closure means against the guides 170, 180 which thus serve as a backing plate during the heat-sealing step.

Various techniques can be implemented for placing the closure means 300 onto the film F.

Preferably, the system of the present invention is adapted to place segments of closure means 300 directly on the film F so as to cover no more than half of the width of the film F.

The length of the segments of closure means 300 is preferably substantially equal to half the width of the film F for bags that are simple, i.e. that do not include bellows.

In contrast, for bags that do include side bellows, the length of the segments of closure means 300 is considerably less than half the width of the film F.

In all cases, the length of the closure means 300 is advantageously equal to the width of the main faces of the bags.

The web 310 which is adjacent to the film is fixed to the film in the deposition station by the heat-sealing jaws 120, while the other web 320 which is superposed thereon is fixed to the inside wall of the bag while the bag is being finished, i.e. after it has been filled. Under such circumstances, the second web 320 can be heat-sealed to the film F using the heat-sealing jaws 50, or else by using additional transverse heat-sealing jaws provided specifically for this purpose.

The widths of the two webs 310 and 320 may be identical. In a variant, the two webs 310 and 320 can be of different widths in order to facilitate heat-sealing the webs on the film in the lateral portions of the webs that project relative to the facing web.

In this context, it is possible initially to secure the wider web or the narrower web.

Once the closure means 300 has been placed transversely over the film F and before it reaches the forming neck 20, means are preferably provided for facilitating the passage via the forming neck 20.

To this end, provision can be made either to have the forming neck 20 off-center relative to the vertical axis of the machine so as to allow the transverse closure means 300 to pass through, or else to provide appropriate clearance at the forming neck 20.

The resulting bags can also be implemented in a wide variety of ways, and mention can be made of the following:

precut lines of perforations can be formed between the closure means 300 and the second transverse line of heat-sealing, as shown diagrammatically in FIG. 5 of document FR 2 745 261 (where such a precut line can be implemented in conventional manner using toothed blades associated with the transverse heat-sealing jaws 50);

"coat-hanger" type curved longitudinal lines of sealing can be made as shown likewise in FIG. 5 of document FR 2 745 261, in particular for applications to liquid containers; such lines of heat-sealing are generally rounded in shape, and convex towards the inside of the bag, converging towards the top thereof which coincides with the second line of transverse heat-sealing; and bags can be made with lateral bellows, as shown diagrammatically in FIG. 6 of document FR 2 745 261, by forming longitudinal folds in the film F before it enters the forming neck 20.

Means are preferably provided, in the form of support webs 310, 320 made of two materials, or equivalent means, to enable the melting temperature on the outside surfaces of the support webs 310, 320 to be lower than the melting temperature on the inside surfaces thereof.

The closure means 300 is preferably made by extruding a plastics material. Naturally, the closure means 300 must have webs 310 and 320 that are sufficiently fine and flexible to accept the deformation shown in FIG. 3.

The film F that is used may also be the subject of numerous variants. It may be a single-layer or multilayer flexible film of plastics material, and it may optionally be coated, e.g. metallized.

The present invention provides numerous advantages over previously existing systems, and particular mention can be made of the following:

the ease with which the closure means 300 are engaged on the rectilinear guide means 170, 180 because of the lateral openings of the webs 310, 320 as imposed when urging is applied thereto;

because the closure means 300 are put into place by traction on rectilinear guides 170, 180, they can be positioned very accurately across the width of the film F and they can be positioned in the rectilinear state;

the invention is very easy to implement; and the bags are leakproof (the closure means extend parallel to the transverse heat-sealing means 50 and do not disturb the operation thereof).

Naturally, the present invention is not limited to the particular embodiments described above, but extends to any variant in the spirit of the invention.

Thus, the invention is mentioned above as being applicable to automatic machines for forming, filling, and sealing film-based packages.

Nevertheless, the invention can also be applied to machines for preparing films that are fitted with strips, which strip-fitted films are subsequently fed to conventional automatic machines for forming, filling, and sealing bags.

According to another advantageous characteristic of the present invention, the installation of the present invention may include a cylinder 250 overlying the film, extending transversely to the displacement direction thereof, and mounted to rotate about its own axis which extends transversely to the displacement direction of the film F. The cylinder 250 possesses a plurality of stations each comprising a pair of rectilinear guides 170, 180 such that when one station having guides 170, 180 is being used for placing a closure means 300 on the film F, another station of guides 170, 180 is being fed with another closure means 300. As shown in FIG. 4, it is possible, for example, to use a cylinder 250 that has two diametrically opposite stations of rectilinear guides 170, 180. While one of the stations having guides 170 and 180 adjacent to the film F is in use for placing a closure means 300 on the film, the other station of guides 170, 180 is being fed with the next closure means. The cylinder is then turned through 180° about its axis so that the station that has now received the closure means is adjacent to the film F and the now empty station is ready to receive a new closure means, etc. . . . .

To release the closure means 300 from the rectilinear guides 170, 180, once heat-sealed to the film F, it is possible either to place the guides 170, 180 on retractable means, e.g. the jaws of a part that is controlled sequentially to open as shown in FIG. 4*bis,* or else to rely on the flexibility of the lateral edges of the webs 310, 320 by ejecting them from the guides 170, 180, e.g. by means of actuators incorporated in the cylinder 250 and under sequential control. Such actuators are shown diagrammatically under reference 260 in FIG. 4.

In a variant, the means 204 shown in FIG. 1 and situated upstream from the film F and the cutting means 206 may also have two auxiliary rectilinear guides 170*bis,* 180*bis* in alignment with the guides 170, 180 respectively that are situated on the cylinder 250, and level with the loading station thereof.

In another variant, two clamps 150 can be provided, one being used for displacing the closure means 300 along the guide means 204, and the other for displacing the closure means 300 along the cylinder 250.

In the embodiments of the invention described above, the closure means are placed on the film transversely to the travel direction thereof.

However, the present invention is not limited to that disposition.

Thus, in other variants, the closure means 300 can be placed on the film F longitudinally, i.e. parallel to the displacement direction thereof, either upstream or downstream from the forming neck 20, or indeed they can be placed at a slant relative to said displacement direction of the film F.

Under such circumstances, the closure means 300 can be placed at a slant on the film F covering the entire width of the bags.

Nevertheless, in a preferred embodiment of the invention, as shown in FIG. 6, the closure means 300 covers only a fraction of the width of a bag, interconnecting two adjacent sides at right angles of the bags, as can be seen in FIG. 6. Such a variant can be used in particular for packaging liquids, with the bag outlet defined by the closure means constituting a spout that can be opened and closed as necessary.

The means used for feeding the closure means 300, in particular for slanting dispositions of the kind shown in FIG. 6, can be the subject matter of numerous variants. They may be as described in document EP-A-0 667 288.

As mentioned above, and as shown in FIG. 7, the present invention also relates specifically to bags S comprising two pairs 302, 304 of complementary male/female type closure strips 312 & 322 and 314 & 324 disposed at the mouth of the bag, with one male strip 322, 314 and one female strip 321, 324 being disposed on each of the sheets making up the bag.

The Applicant has observed that such bags are particularly well suited to packaging a substance in powder form.

This disposition reduces the risk of the closure strips, and in particular the female closure strips 312, 324 becoming filled with powder while the bag is being filled or emptied. As a result, when a bag is emptied, at least one of the female strips 312 and 324, i.e. the strip located on the upper sheet, is kept clear of the substance in powder form as it leaves the bag.

Figure 7:
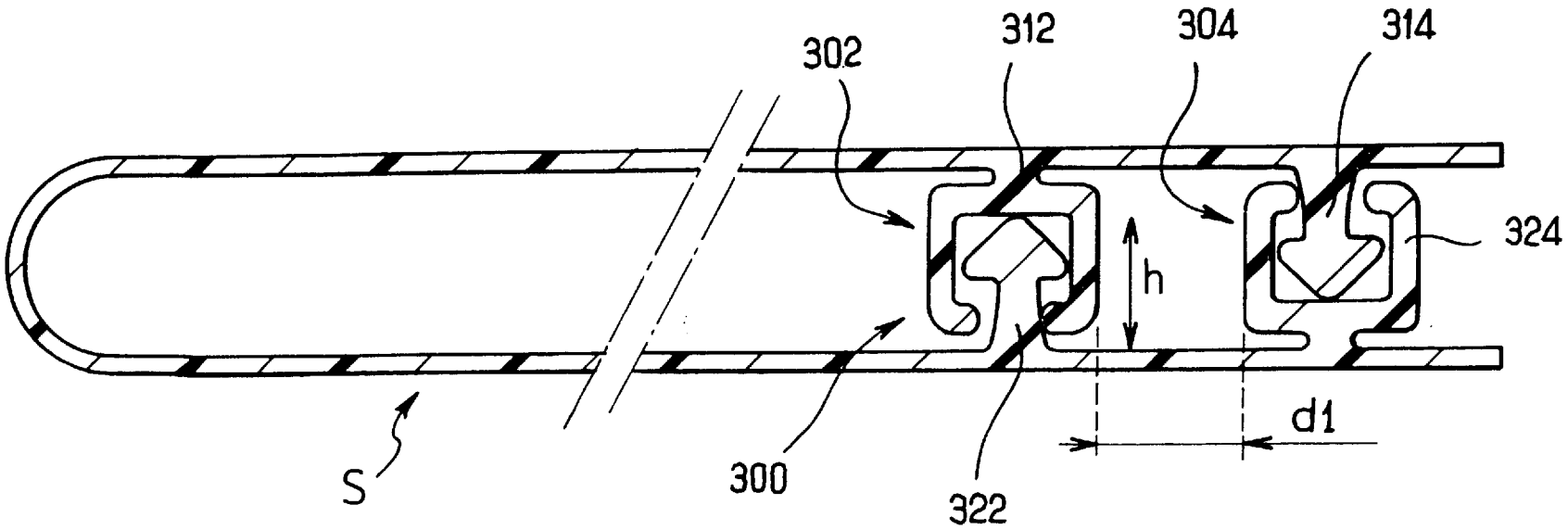
FIG. 7 is a diagram of a bag of the present invention having two pairs of complementary closure strips.

More precisely still, such bags are particularly satisfactory when the distance d1 between the two pairs of strips 302 and 304 is greater than 1 mm and/or when the female closure strips 312, 324 are of the type having converging edges, as shown in FIG. 7.

The applicant has also observed that the resulting bags are particularly satisfactory when the ratio h/d1 of the height of the strips over the spacing between them is greater than 1.5.

In this context, it should also be observed that in a variant embodiment of the present invention, the closure strips 302, 304 can be extruded onto the film constituting the bag rather than being applied ready-made to the film as described above.

Also, in the context of the present invention, at least for implementing packages of the type shown in FIG. 7, the female closure strips are made of a flexible material enabling the converging edges to be highly resilient, the material preferably being selected from the group comprising low density polyethylene and ethylene copolymers, e.g. pure or mixed E/VA copolymers, having a modulus of elasticity smaller than that of low density polyethylene.

What is claimed is:

1. A machine for forming packaging based on film and including complementary closure strips, the machine comprising:

feeder means for feeding onto the film a closure means comprising two generally-parallel support webs provided, on their facing inside surfaces and at a distance from their lateral edges, with at least a first longitudinal assembly constituted by two complementary strips connected to respective ones of the two support webs, and with a second longitudinal assembly disposed at a distance from the first assembly in the width direction of the support webs;

urging means for urging the support webs towards each other between the two longitudinal assemblies and at least at the ends of the support webs, so that by deformation of the webs under the effect of said urging the distance between the lateral edges of the two webs increases; and two rectilinear guides suitable for penetrating into the respective spaces formed in this way between the two pairs of lateral edges of the support webs.

2. A machine according to claim 1, constituting an automatic machine for forming, filling, and sealing packages based on film, the machine comprising a forming neck which receives at its input the film in the flat state taken from a payout stand and which delivers at its output the film shaped into a tube, a filler chute opening out into the forming neck and consequently into said tube, means for feeding closure means onto the film and for fixing them to the film, longitudinal heat-sealing means for closing the tube longitudinally, and means suitable for generating sequentially a first transverse line of heat-sealing before a product is inserted into the tube via the filler chute, and then a second transverse line of heat-sealing after the product has been inserted into the tube, in order to close a package around the product.

3. A machine according to claim 1, wherein the forming machine constitutes a machine for preparing film fitted with closure strips, which film fitted with closure strips is subsequently fed to automatic machines for forming, filling, and sealing packaging.

4. A machine according to claim 1, wherein the feeder means are adapted to take segments of closure means of length no greater than about half the width of the film, to feed them transversely over the film before the film reaches a forming neck, and to fix a first one of the support webs on the film, and wherein means are also provided suitable for fixing the second support web to the inside wall of the film once formed into a bag, after the bag has been filled, while the bag is being finished.

5. A machine according to claim 1, wherein the urging means comprise temporary urging means.

6. A machine according to claim 5, wherein the urging means comprise a clamp or equivalent means.

7. A machine according to claim 1, wherein the urging means comprise permanent urging means.

8. A machine according to claim 1, wherein the urging means comprise a line of heat-sealing formed between the support webs and between the two longitudinal assemblies at each of the ends of the support webs.

9. A machine according to claim 8, wherein the urging line of heat-sealing is made prior to feeding the segments of closure means onto the film.

10. A machine according to claim 8, wherein the urging line of heat-sealing is made upstream from a cutting station, with the cut being made through the middle of a line of heat-sealing made in this way so that a single line of heat-sealing thus forms a bond both between the trailing ends of the webs of a first segment of the closure means, and between the leading ends of the webs of a second segment thereof.

11. A machine according to claim 1, wherein the second assembly is also constituted by two complementary strips respectively bonded to the two support webs.

12. A machine according to claim 1, wherein the second assembly is formed by a single rib or reinforcement projecting longitudinally from the inside surface of one of the webs or from each of the webs.

13. A machine according to claim 1, wherein each of the support webs carries a male strip and a female strip.

14. A machine according to claim 1, wherein one of the webs carries two male strips and the other web carries two female strips.

15. A machine according to claim 1, wherein the distance between the two longitudinal assemblies is greater than the distance defined at rest between the webs by said assemblies.

16. A machine according to claim 1, wherein the distance between the two longitudinal assemblies lies in the range one to five times the distance defined at rest between the webs.

17. A machine according to claim 1, wherein the feeder means include at least one suction head or a clamp suitable for moving the closure means along guides by applying traction to the upstream end of the closure means.

18. A machine according to claim 1, wherein the segments of closure means are heat-sealed to the film by a heat-sealing jaw underlying the film and controlled sequentially towards and away from the film to pinch the film and the web of the closure means against the guides which thus serve as a backing plate during the heat-sealing step.

19. A machine according to claim 1, wherein the length of the segments of closure means is substantially equal to half the width of the film for simple bags, without bellows, while the length of the segments of closure means is considerably less than half the width of the film for bags that include lateral bellows, in all cases the length of the closure means is of the same order as the width of the main faces of the bags.

20. A machine according to claim 1, wherein the two support webs of the closure means are of different widths.

21. A machine according to claim 20, wherein the wider web is the first web to be fixed to the film.

22. A machine according to claim 1, including a cylinder overlying the film transversely to the displacement direction thereof, and mounted to rotate about its axis which extends transversely to the displacement direction of the film, the cylinder having a plurality of stations comprising rectilinear guides such that while one station of guides is in use for placing a closure means on the film, another station is being fed with closure means.

23. A machine according to claim 1, wherein the rectilinear guides are placed on retractable means, on jaws of a clamp that is controlled in sequence to open, thereby releasing the closure means.

24. A machine according to claim 1, wherein the rectilinear guides are associated with actuators suitable for ejecting segments of closure means so as to release them.

25. A machine according to claim 1, wherein the closure means are placed on the film transversely to the displacement direction thereof.

26. A machine according to claim 1, wherein the closure means are placed on the film parallel to the displacement direction thereof.

27. A machine according to claim 1, wherein the closure means are placed on the film at a slant relative to the displacement direction thereof.

28. A machine according to claim 27, wherein the closure means cover a fraction of the width of the bags, interconnecting two adjacent and orthogonal sides thereof.

29. A machine according to claim 22, having two auxiliary rectilinear guides in alignment with the respective guides situated on the cylinder and level with the loading station thereof, upstream from cutting means.

30. A method of making packaging based on film and including complementary closure strips, the method comprising the steps consisting in:

feeding onto the film closure means comprising two generally parallel support webs provided on their facing inside surfaces and at a distance from their lateral edges, with at least a first longitudinal assembly constituted by two complementary strips bonded respectively to the two support webs, and with a second longitudinal assembly disposed at a distance from the first assembly in the width direction of the support webs;

urging the support webs towards each other between the two longitudinal assemblies so that the distance between the lateral edges of the two webs increases under the effect of said urging, because of the webs being deformed; and engaging the closure means on two rectilinear guides in such a manner that the guides penetrate into the respective gaps formed in this way between each pair of lateral edges of the support webs.

31. A method according to claim 30, implemented on an automatic machine for forming, filling, and sealing packages based on film, the machine comprising a forming neck which receives at its input the film in the flat state taken from a payout stand and which delivers at its output the film shaped into a tube, a filler chute opening out into the forming neck and consequently into said tube, means for feeding closure means onto the film and for fixing them to the film, longitudinal heat-sealing means for closing the tube longitudinally, and means suitable for generating sequentially a first transverse line of heat-sealing before a product is inserted into the tube via the filler chute, and then a second transverse line of heat-sealing after the product has been inserted into the tube, in order to close a package around the product.

32. A method according to claim 30, implemented to prepare a film fitted with closure strips, which film fitted with closure strips is subsequently fed to an automatic machine for forming, filling, and sealing packaging.

33. A method according to claim 30, wherein the urging means comprise temporary urging means.

34. A method according to claim 33, wherein the urging means comprise a clamp or equivalent means.

35. A method according to claim 30, wherein the urging means comprise permanent urging means.

36. A method according to claim 30, comprising a step consisting in forming a line of heat-sealing between the support webs and between the two longitudinal assemblies at the ends of the support webs.

37. A method according to claim 36, wherein the urging line of heat-sealing is made prior to feeding segments of closure means onto the film.

38. A method according to claim 36, wherein the urging line of heat-sealing is made upstream from a cutting station, said cutting being performed through the middle of a line of heat-sealing made in this way, such that a single line of heat-sealing forms both a bond between the trailing ends of the webs of a first segment of closure means, and between the leading ends of the webs of a second segment thereof.

* * * * *